US005448840A

United States Patent [19]

Cheskin

[11] Patent Number: 5,448,840

[45] Date of Patent: Sep. 12, 1995

[54] SHOE CONTAINING ELECTRICALLY CONDUCTIVE INTEGRAL ELEMENTS

[76] Inventor: Melvyn Cheskin, 65 Cardinal Ct., Braintree, Mass. 02184

[21] Appl. No.: 180,149

[22] Filed: Jan. 11, 1994

Related U.S. Application Data

[63] Continuation of Ser. No. 24,193, Feb. 26, 1993, abandoned, which is a continuation of Ser. No. 701,656, May 16, 1991, abandoned.

[51] Int. Cl.[6] ..... A43B 13/04

[52] U.S. Cl. ..... 36/32 R; 36/68; 361/224

[58] Field of Search ..... 36/7.1 R, 7.3, 9 R, 36/113, 32 R, 30 R, 68, 69, 4, 84; 361/223, 224

[56] References Cited

U.S. PATENT DOCUMENTS

| | | | |
|---|---|---|---|
| 2,287,744 | 6/1942 | Monahan | 361/223 |
| 2,650,327 | 8/1953 | Legge | 361/223 |
| 2,671,185 | 3/1954 | Bloom | 317/2 |
| 3,281,624 | 10/1966 | Patchen | 317/2 |
| 3,381,173 | 4/1968 | Woskin | 317/2 |
| 3,684,922 | 8/1972 | Ericson | 36/7.1 R |
| 3,694,939 | 10/1972 | Chen | 36/7.3 |
| 3,737,723 | 6/1973 | Kanor | 317/2 B |
| 3,852,895 | 12/1974 | Funck | 36/2.5 R |

*Primary Examiner*—Steven N. Meyers
*Assistant Examiner*—Thomas P. Hilliard

[57] ABSTRACT

A shoe for enhancing human physical performance by establishing an electrical conduit between the body and the ground is described. The shoe outsole is formed of a conductive rubber material. A resilient conductive element is integral with the outsole and extends along a portion of the outer surface of the shoe upper, typically being secured to and around at least a portion of the collar of the shoe and further extending over at least a portion of the inside surface of the upper.

17 Claims, 5 Drawing Sheets

SHOE CONTAINING ELECTRICALLY CONDUCTIVE INTEGRAL ELEMENTS

This application is a continuation of application Ser. No. 08//024,193 filed on Feb. 26, 1993, now abandoned, which is turn is a continuation of application Ser. No. 07/701,656, filed May 15, 1991 now abandoned.

FIELD OF THE INVENTION

The present invention relates to shoes containing electrically conductive components and more particularly to an integral shoe design having an electrically conductive component for providing an electrical conduit between the user's foot and the ground.

BACKGROUND OF THE INVENTION

It has been known for many years to provide electrically conductive components in connection with footwear which exhibit the ability to conduct electrical charge to ground for various purposes. U.S. Pat. No. 2,305,542 discloses a process for rendering leather conductive, and U.S. Pat. No. 3,013,184 discloses a booty with an electrically conductive sole.

Other footwear exhibiting somewhat less ability to conduct electrical charge has been used by persons in the electronic and computer industries who must void and/or discharge static electricity which may build up upon the clothing and body.

Various methods have been proposed for causing static electricity to be discharged from the body and clothing and these expedients have often resulted in cumbersome, expensive and poorly designed shoes. For example, there have been proposed body grounding straps in U.S. Pat. No. 2,586,747 and U.S. Pat. No. 2,712,098, and other antistatic or conductive straps in various forms and for various purposes such as, for example, in U.S. Pat. Nos. 4,083,124; 3,694,939; 4,551,783; and 3,737,723. Electrically conductive elements comprising or extending through various shoe sole layers such as foot pad, insole, midsole and the like in order to make contact with the bottom sole of the wearer's foot have been designed in various forms as, for example, in U.S. Pat. Nos. 2,261,072; 2,710,366; 3,079,530; 4,727,452; 4,366,630; 4,689,900; and 4,785,371. Other electrically conductive elements have been used in footwear designs such as described in U.S. Pat. Nos. 4,532,724 and 3,898,750. All these devices may be uncomfortable to wear, difficult or expensive to manufacture, unsightly or structurally awkward or unsound.

SUMMARY OF THE INVENTION

It is an object of the present invention to provide a rugged integral footwear design which can control the dissipation of electrical charges between the body and the substrate with which the bottom of the footwear normally makes contact.

It is a further object of the present invention to provide a shoe construction that brings a portion of the shoe which makes substantial contact with the ground during normal use such as the outsole into direct electrical contact with the human body.

It is another object of the invention to provide a shoe that can improve human physical performance by harnessing the electrical force in the earth with the body's electrical energy.

Normally, a shoe comprises electrically non-conductive components or has a conductive component which do not allow for an electrical conduit between the wearer's foot and the ground. The wearer's foot is typically insulated from the ground especially in athletic footwear where the outsole is typically comprised of non-conductive rubber.

The invention provides for a shoe construction that includes one or more electrically conductive elements. In a preferred embodiment the shoe includes a portion of its upper integrally formed together with a conductive elastomeric outsole. The outsole makes contact with the ground or environmental substrate under normal wearer use. A midsole is typically positioned above the outsole and a sockliner is typically positioned above the midsole. An insole or other sole layer component may also be included as one of the various separate sole layers of the shoe. The sockliner typically makes contact with the bottom of the wearer's foot. The various other sole layers are typically disposed between the top surface of the outsole and the undersurface of the sockliner. Preferably the outsole includes an electrically conductive component such as carbon particles.

The shoe construction further includes a means for transferring an electrical charge directly from the environmental substrate through the conductive outsole to a portion of the wearer's foot. In preferred embodiments, an electrically conductive element integrally formed together with the outsole extends along the outside of the shoe upper to the ankle area without the need for internal apertures, protrusions or other modifications of shoe sole components such as sockliner, insole, midsole, outsole or the like. In another embodiment, the electrically conductive element connected to the conductive outsole extends up the side of the shoe to ultimately make contact with the wearer's ankle.

FIG. 1 shows a typical shoe which includes an upper 12', a sockliner 26, a midsole 24 and an outsole 20 in a sequence whereby the bottom of the foot makes first contact with the sockliner. The sockliner is separated from the outsole by the midsole. Each of the sockliner, midsole and upper are typically comprised of non-conductive materials such as cloth, plastic, leather, rubber, foam or other non-conductive polymeric materials such that electrical conductivity between the foot and the ground with which the outsole makes direct contact essentially impossible in the absence of some specific provision being made for the normally non-conductive outsole to be rendered conductive and further provision for the outsole to penetrate through the midsole and sockliner to make direct contact with the bottom of the foot. Alternatively, a conductive path between the sockliner and outsole could be made by rendering all of the various sole layer components separately conductive including the adhesives between the various layers. Because the materials of which a sockliner, insole, midsole and outsole are comprised are typically different and separate, creating an effective electrically conductive path between the bottom of the wearer's foot and the outsole is difficult and expensive because it requires rendering all of the separate layer materials separately conductive and securely connecting them to each other by conductive means.

Most preferably, the conductive extension integrally formed together with the outsole, is also securely attached to the upper of the shoe such that it is essentially integral with the upper of the shoe.

Further in accordance with the invention there is provided a method of increasing the muscular strength of a human being wearing shoes having a rubber outsole above a normal exercise level by rendering the rubber outsole electrically conductive, contacting the foot with a conductive member in conductive contact with the conductive outsole and having the human being perform an athletic exercise standing in the shoe having the conductive outsole such that the conductive outsole is in contact with the ground.

As used herein the term "outsole" is meant to be any sole layer component of the shoe which makes substantial contact over a relatively wide area with ground during normal wear such as by way of the exemplary outsole patterns shown in FIGS. 2, 3.

BRIEF DESCRIPTION OF THE DRAWINGS

The above, and other objects, features and advantages of this invention will be apparent in the following detailed description of exemplary embodiments of the invention which are to be read in connection with the accompanying drawings wherein.

DETAILED DESCRIPTION OF THE INVENTION

Figure 1:
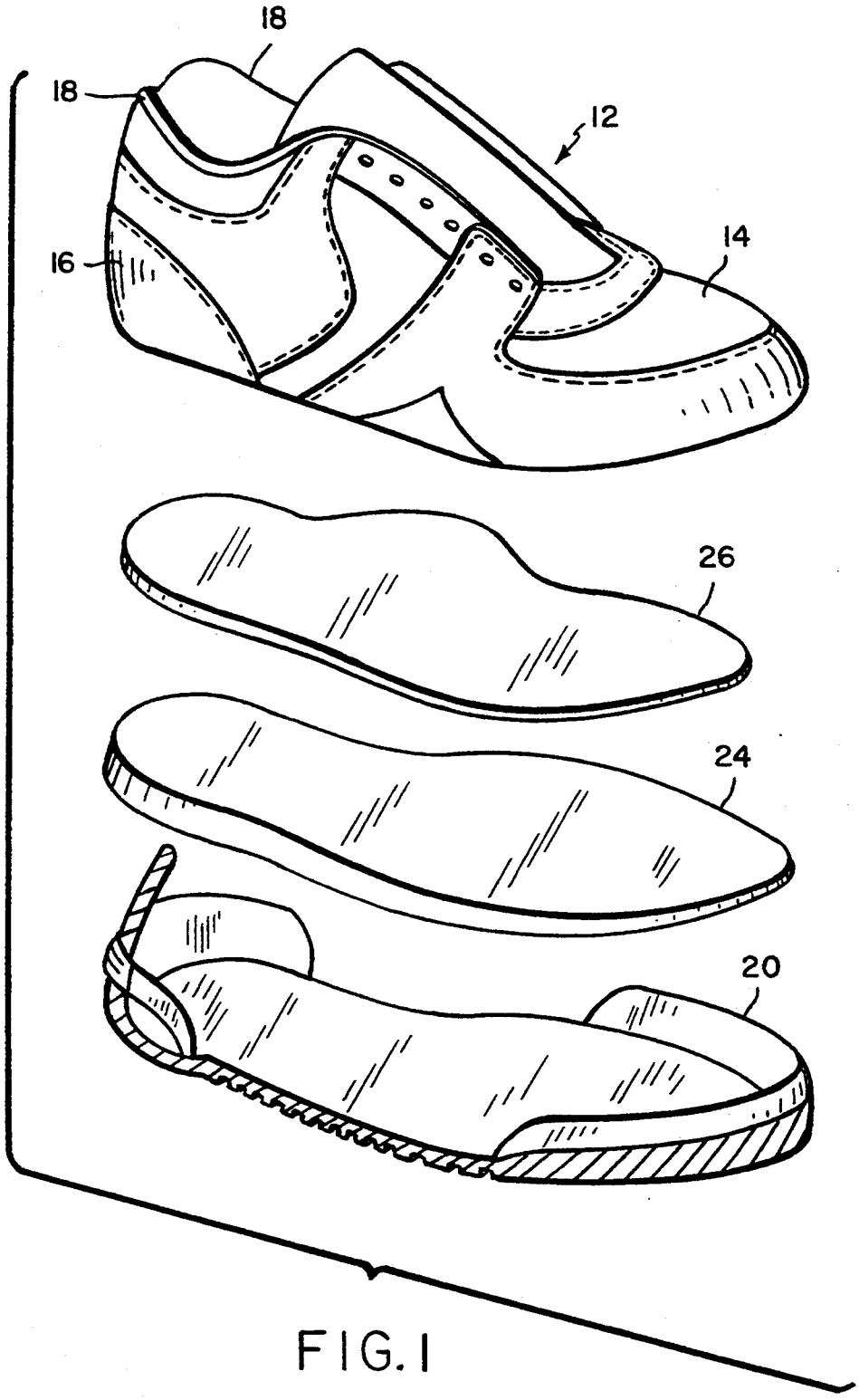
FIG. 1 is an exploded perspective view of an exemplary shoe design according to the present invention.

This invention pertains to a shoe that contains conductive material designed to establish an electrical bond between the human body and the environmental substrate with which the shoe normally makes contact when worn on the foot. In particular, establishment of an electrical contact between the human body and an environmental substrate (e.g. $10^4$–$10^6$ ohms-cm path to ground) can harness electrical energy in the environment with the body and affect the muscular physical performance of the wearer such as jumping, lifting, throwing, pushing, pulling and the like.

Without wishing to be bound by any theory, it is well known that electrical fields can affect biological cells. In particular, electric fields can affect actin, a proteinaceous component of contractile muscle fibers. Moreover, the earth and the atmosphere generate an electric field of approximately 100–150 volts per meter, this value increasing considerably under certain conditions. This so-called "coronal" electrical field in the earth/atmosphere system interacts with the human body so that a person can intercept approximately 260 volts of electricity generated by the earth and atmosphere.

The shoe design of the invention employs conventional polymeric materials as the conductive component. For example, the outsole of an athletic shoe, typically comprised of rubber which is non-conductive, is rendered electrically conductive by dispersing conductive particles or other conductive material(s) in the polymer such as electrically conductive carbon, silver, gold, or other electrically conductive metal particles, metal coated carbon particles, metal coated silica particles, metal flake particles and the like. Examples of specific materials which may be blended with a rubber to render it conductive are carbon blacks such as XC-72 and N.550 black. Most preferably the conductive particles are homogeneously dispersed throughout the rubber by conventional blending methods to achieve an ohmic path between the body of the shoe wearer and the ground of between about $10^3$ and about $10^7$ ohms-cm, typically $10^4$–$10^6$ ohms-cm. Without conductive material added thereto, rubber normally has an essentially infinite resistivity and is essentially completely non-conductive.

An integral extension of the ground contacting outsole extends from a peripheral edge of the outsole upwardly around the edge of other shoe sole components such as sockliner, insole and midsole to the "upper" of the shoe and is integrally attached to the inside or outside surface of the upper of the shoe such that the conductive integral extension makes substantial contact with the foot of the wearer. The integral extension most preferably comprises the same conductive rubber material of which the outsole is comprised and the conductivity of the extension is preferably identical to the conductivity of the outsole material. The extension being unitary or integral with the outsole obviates any potential discontinuity in electrical flow or faulty contact between separate conductive components which would otherwise have to be connected in order to establish conductive flow therebetween. In a most preferred embodiment, the extension is also integrally formed together with the upper of the shoe in the sense that the extension is sewn or stitched together with or otherwise integrally attached to the non-conductive material comprising the upper of the shoe thereby obviating potential problems with the extension becoming disengaged from the shoe upper or from contact with the foot.

Referring to FIG. 1, illustrated generally at 10 is an athletic shoe of the invention which is but one of many possible styles and variations of footwear to which the present invention is applicable. Although the preferred embodiment is directed to an athletic shoe as shown in FIG. 1, the shoe may be one of other shoe types such as casual, loafer, flats, wedges, steel-toed safety, and the like.

Shoe 10 includes an upper, designated generally at 12. The upper 12 is formed of any material useful for shoe construction, as described in more detail below, to provide a forepart 14 and a heel portion 16. The upper also includes a collar 18 which is typically the top line of the shoe that encircles the ankle of the wearer's foot.

Upper 12 is secured by known securement or welting techniques to an outsole generally designated 20 including an integrally formed heel portion, represented as a heel counter 22. Methods of matching the sole and other bottom components to the upper can be found in M. P. Cheskin et al., "*The Complete Handbook of Athletic Footwear*"; Fairchild Publications, New York, (1987), the entire contents of which are incorporated herein by reference.

Referring again to FIG. 1, a midsole 24 is juxtaposed relative to the outsole 12, preferably provided within the shoe in contact with the outsole. Provided within the shoe and juxtaposed relative to the midsole 24 is a sockliner 26. The upper 12 is typically formed of leather, cloth, canvas or any other synthetic material such as polyvinyl chloride (PVC), polyurethane (PU) or so-called poromeric materials useful for shoe construction. Leather materials preferred in the production of footwear are, for example, leathers derived from calfskin, cowhide, pig, antelope, goat, deerskin and suede varieties of the above. Other materials that can be used for the upper, especially in athletic footwear include polyvinyl chloride (PVC), nylons, and microporous sheet materials consisting of a polyurethane (PU) material reinforced with polyester.

Materials used for the midsole 24 can be made of polyurethane (PU). Polyurethane midsoles can be injected directly or cemented as a unitary midsole. Preferably, the polyurethane has a cellular structure with a hardness of between approximately 30 and 90 shore A. Another preferred midsole component is ethylvinyl acetate (EVA). EVA is a chemical blend of ethylene and vinylacetate and forms a cellular structure when vulcanized with a hardness of between about 30 and about 35 shore A. In athletic footwear, a preferred embodiment of the invention, the midsole 24 provides shock absorption, comfort, and spring capability due to its resilience for enhancing physical performance by the wearer.

Referring again to FIG. 1, the outsole 20 is preferably made of rubber or rubber-like material, referred to herein as an elastomer. The term "elastomer" is meant to encompass materials including natural and synthetic rubbers possessing characteristic elastic properties, and/or any substances, including mixtures containing natural rubber, that have rubber-like qualities. The outsole 20 is typically formed of carbon rubber and styrene-butadiene rubber. Black carbon rubber is the hardest wearing rubber and is preferably used in shoe constructions designed for running. Styrene-butadiene rubber is preferably used for flat-soled shoes involved in tennis and basketball. Other elastomeric materials useable in shoes according to the invention include polychloroprene elastomers (Neoprene). See also Cheskin et al., supra, pages 135–137, incorporated herein by reference.

The outsole 20, is preferably molded from one of the elastomers described above and is formed as a mixture incorporating electrically conductive particles or other conductive material. This material is typically carbon particles but can be any other type of electrically conductive material so long as the distribution of the conductive material in the mixed material of the outsole is sufficiently concentrated and homogeneous to provide an ohmic path between the foot and the ground having a resistance of between about $10^3$ and about $10^7$ ohms-cm. In preferred embodiments of the invention, conductive particles 28 in combination with the elastomeric material of the outsole 20 provide a volume resistivity sufficient to provide an overall resistance from foot to ground through the outsole of between about $10^4$ and about $10^6$ ohms-cm. In a preferred exemplary embodiment, the heel area of the upper 16 of the shoe, is integrally formed with the outsole 20, and has the same resistivity. The resistivity values refer to conventional bulk or volume resistivity measurements which define current flow per unit area through a volume of material.

Figure 2:
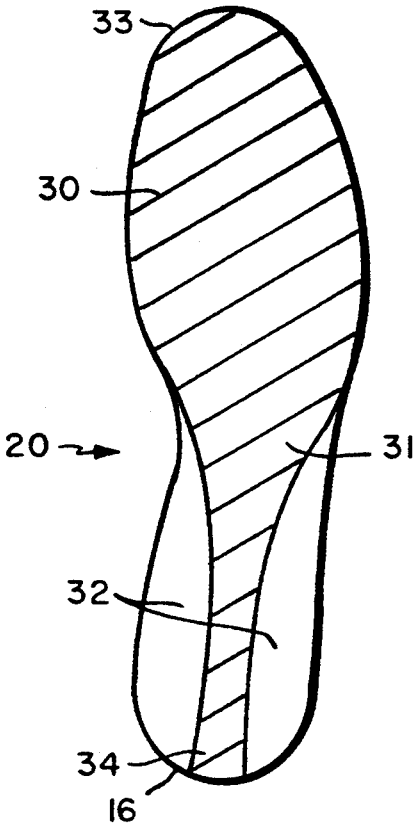
FIG. 2 is a bottom view of an embodiment of an electrically conductive outsole pattern according to the present invention.

The structural design of the outsole can be configured in a variety of ways depending on the particular shoe type and activity for which the shoe is designed. As shown in an exemplary bottom sole outline in FIG. 2, the outsole 20 extends along at least a major portion of the length of the bottommost surface of the shoe 10 from the toe area 33 to the heel 16, beginning at a point proximal to the ball of the foot and extending to the heel 16 of the foot. The electrically conductive material may comprise the entire outsole but may be proportionally smaller than the entire outsole 20 in order to define marginal non-conductive areas or spaces 32 which may be upwardly turned which would not normally make contact with the ground. The sole pattern illustrated in FIG. 2 therefore includes an electrically conductive portion 30 shown in lined outline that has a substantially widened forward section under a forepart of the foot, a narrow instep section 31 and a narrow heel portion 34 under the heel, the heel portion being similar, or slightly greater in width than the width of the instep portion 31. This configuration is useful for court sports such as basketball or racketball. The greater surface area is provided at the forepart of the foot so that conductivity can be transmitted to the push-off or jumping part of the foot.

Figure 3:
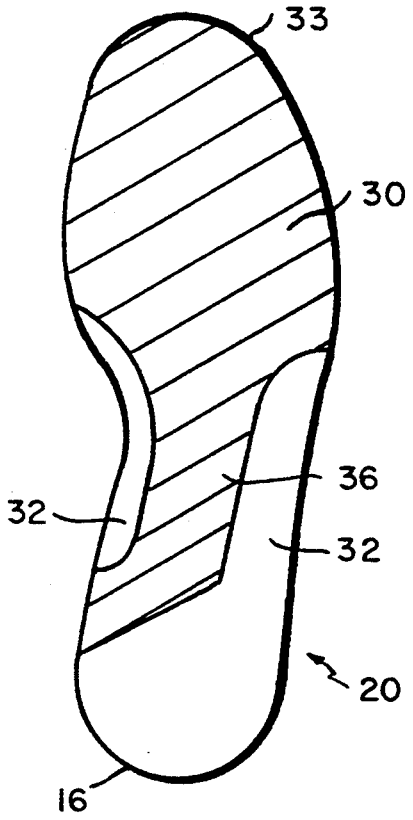
FIG. 3 is a bottom view of another embodiment of an electrically conductive outsole pattern according to the present invention.

In another embodiment of the outsole 20, shown in FIG. 3, a typical pattern of outsole conductive portions 30 (shown in lined outline) for a shoe is designed primarily for running and walking. The electrically conductive elements conform in general shape to the forward portion under the forepart of the foot with a narrower instep portion 36 being defined under the arch of the foot and areas 32 which are non-conductive.

In order to provide an electrical conduit between the ground or environmental substrate and the wearer's body, an integral extension from the bottom of the outsole extends upward to make contact with the body. In one preferred embodiment, this integral member extends from the outer edge periphery of the outsole up to the shoe collar 18 where it contacts the wearer's foot or sock.

Figure 4:
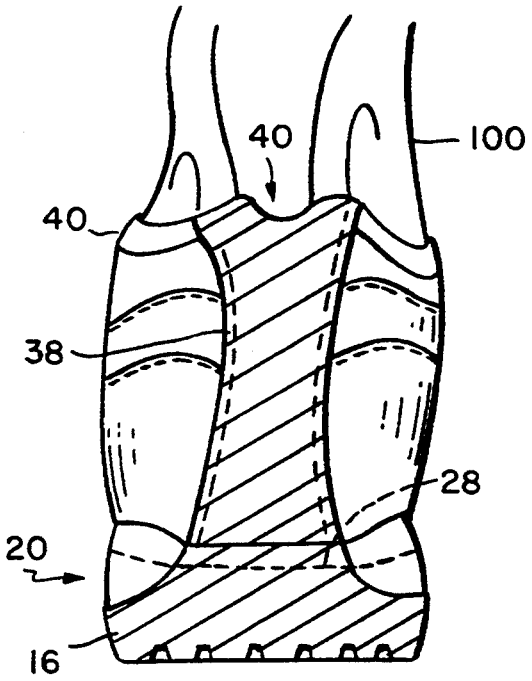
FIG. 4 is a back or heel area view of a shoe design according to the present invention.
Figure 5:
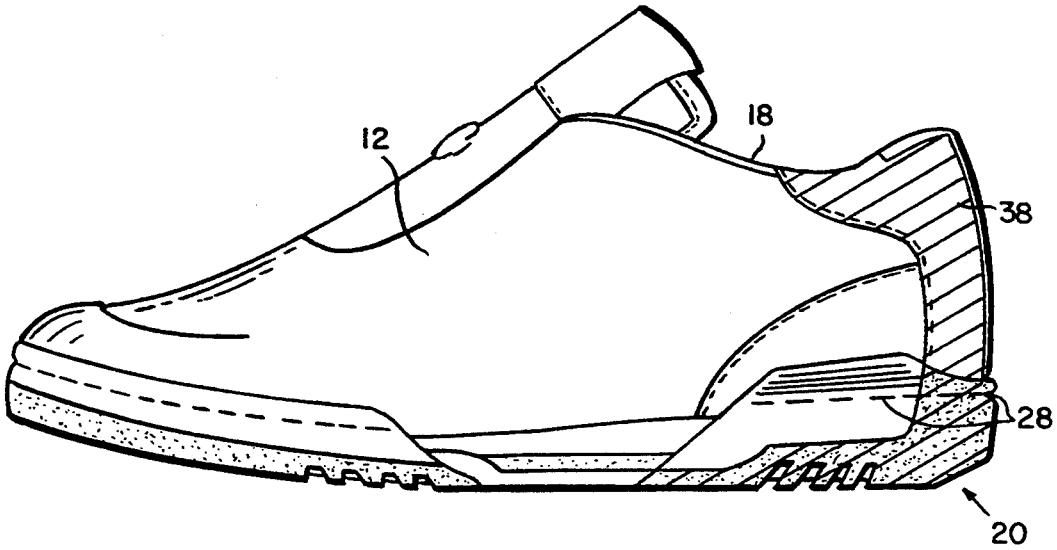
FIG. 5 is a side view of a shoe design according to the present invention illustrating another embodiment.
Figure 6:
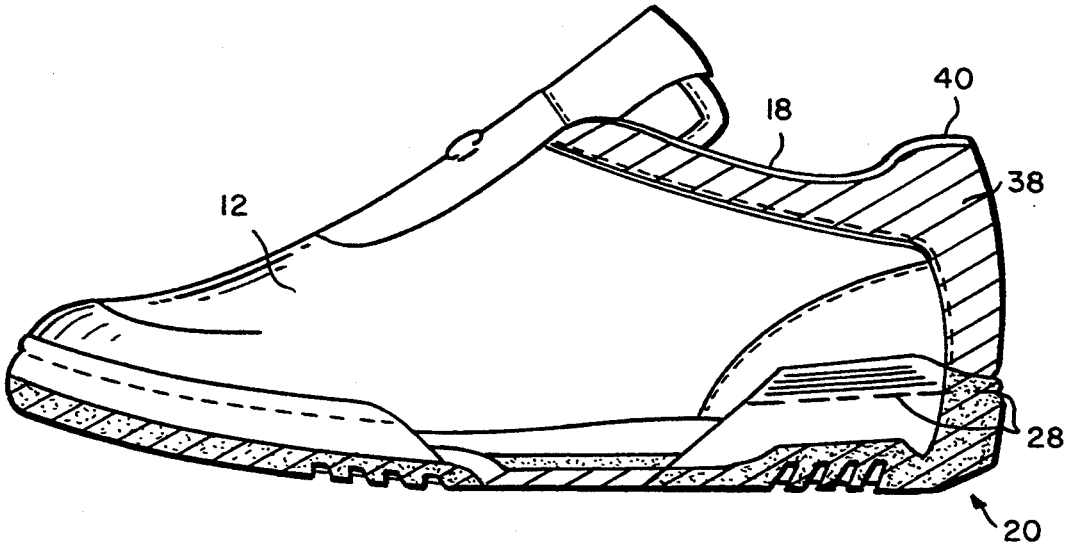
FIG. 6 is a side view of a shoe design according to the present invention illustrating another embodiment.

In the embodiments shown in FIGS. 4–6 the outsole 20 is shown in dotted outline to schematically represent conductive particles 28 dispersed throughout the rubber outsole material and the conductive extension 38 is shown in lined outline. As described herein, the extension may be formed to be unitary with the outsole, for example, by molding the outsole such that the extension is molded together with the outsole as a unitary extension of the normal outsole pattern. Alternatively the extension may be made unitary with the outsole by welding a separately molded extension 38 onto a separately molded outsole by conventional methods such as vulcanization wherein the separate outsole and separate extension are overlapped and melted together and then resolidified to form a unitary overlapped area.

The extension 38 and the outsole may alternatively be made integral with each other by overlapping and stitching 28 the two together such that the separate components are in structurally permanent and integral conductive contact with each other. In a preferred embodiment the extension 38 comprises the same rubber material as the outsole is comprised of, and the extension 38 has the same conductive particle or other material dispersed in its rubber matrix as the outsole has, in, preferably, the same concentrations or amounts. In any event, the bulk or volume resistivity of the extension 38 is in the same preferred range as the outsole 20. Most preferably the volume resistivities of the two are the same.

In one embodiment shown in FIG. 4, an integral extension 38 of the outsole 20 extends upwardly over the outside surface of the heel strip area of the upper 12. As shown by the dashed line area in FIG. 4, the extension 38 extends up to the top 40 of the collar in the heel area and typically over the edge of the collar and at least slightly downwardly over the top 40 along the inside surface of the upper 42 in the collar area to insure contact of the extension with the rearwardmost heel area of the foot/ankle 100 during normal wear.

In another embodiment shown in side view in FIG. 5, a heel area extension 38 integral with outsole 20 extends over the outside surface of the heel area of upper 12 and about halfway around the collar 18 in the rear thereof. Preferably the extension 38 extends over the top of the collar 18 and at least slightly downwardly along the inside surface of the collar 18 to insure contact with the foot during normal use/wear. In another alternative embodiment, FIG. 6, the extension 38 extends around the entire collar 18 and slightly downwardly inside the collar area.

Figure 7:
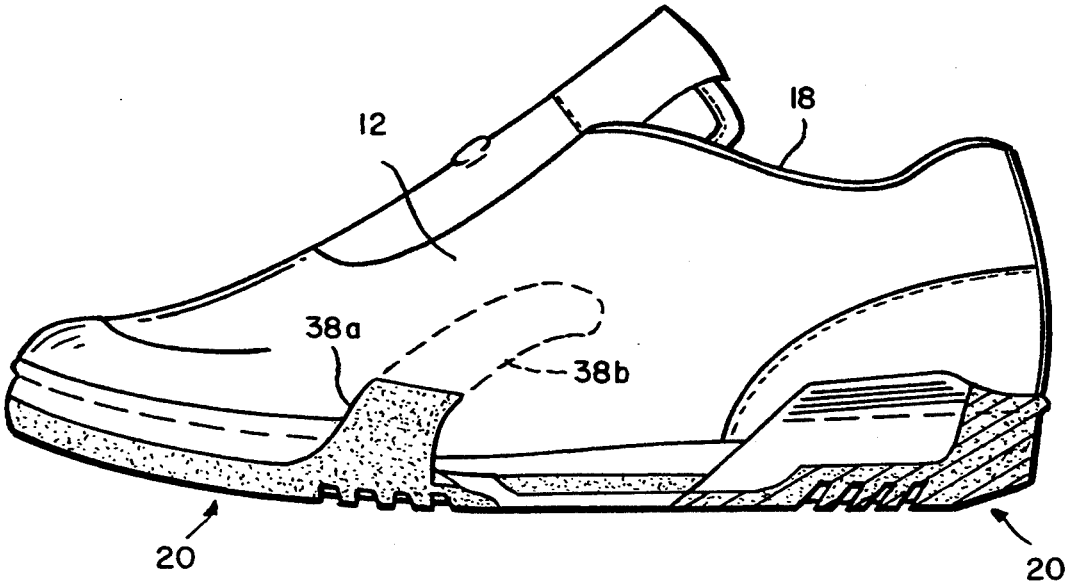
FIG. 7 is a side view of a shoe of the present invention illustrating another embodiment.

In another embodiment, an integral extension **38*a* and 38*b* may extend upwardly along an inside surface of the upper as shown by the dashed lines in FIG. 7. Where the extension is configured to extend along the inside surface of the upper, the extension may more easily be disposed along a forward or anterior surface of the upper as shown in FIG. 7. In the FIG. 7 embodiment, the integral extension comprises a first portion 38*a* extending upwardly from the outsole 20 over the outside surface of an anterior portion of the upper 12 and a second portion 38*b* integrally extending from portion 38*a* through an aperture in the upper 12 and along a portion of the inside surface of the upper 12 such that the portion 38*a* can make direct contact with the wearer's foot. In a similar fashion, the extension 38*b* could be configured to extend along the inside surface of the upper beginning at a lower point, for example, at the peripheral edge of the upper. In any case, the extension extends around the peripheral edges of any shoe sole layers which may be disposed on top of the outsole 20**. An extension extending along an inside surface of the upper can more readily insure contact with the wearer's foot.

Figure 8:
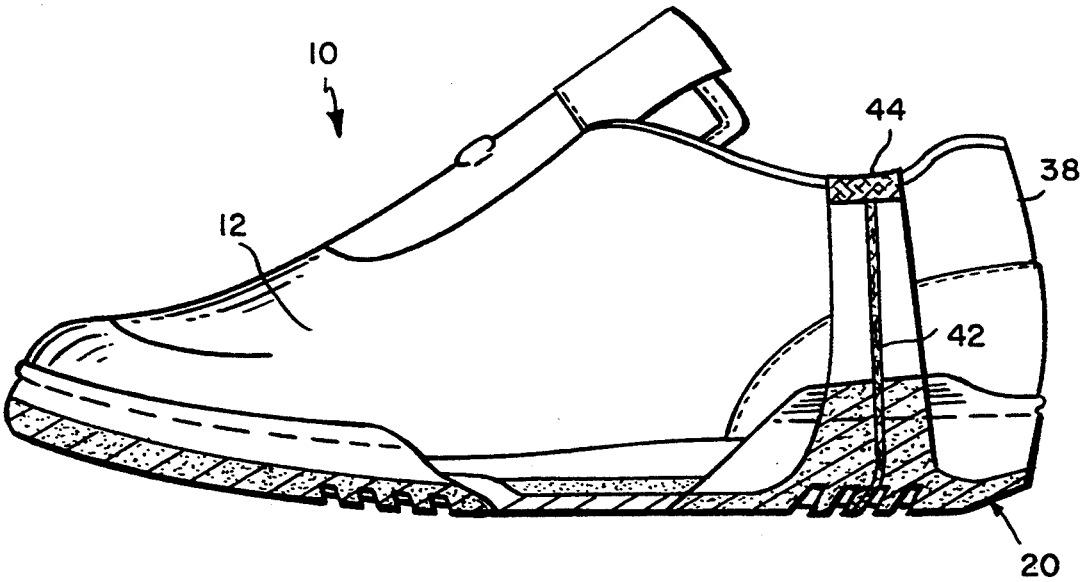
FIG. 8 is a side view of a shoe of the present invention illustrating another embodiment.

In an embodiment shown in FIG. 8, the extension member 38 containing a conductive wire 42 embedded within the rubber matrix of member 38 is affixed to the side of the shoe rather than to the back of the heel. FIG. 8 illustrates member 38 extending in a perpendicular direction upwards from the side of the heel and terminating in a metal clip, extending over the collar along an inside surface of the shoe such that a portion of the wearer's foot adjacent the ankle bone is insured of contact with the metal clip during normal wear. As shown in FIG. 8, a lower portion of the member 38 in dotted outline contains conductive particles dispersed throughout and an upper portion shown in blank outline does not contain conductive particles. The copper wire 42 creates an electrical conduit between the metal clip 44 and the conductive outsole in lieu of conductive particles being dispersed within the upper blank portion of integral extension 38. Although in the FIG. 7 embodiment as described, the blank portion of integral extension 38 does not contain conductive particles, such portion could include conductive particles which would work in conjunction with copper wire 42 to create an electrical conduit.

The extension 38 shown in all embodiments are stitched, sewn, welted or otherwise fixedly attached to the upper 12 such that the extension 38 is essentially integral with the upper.

In all embodiments, the extension preferably extends from a peripheral edge of the outsole 20 around and above a peripheral edge of any sole layers disposed on top of the outsole 20.

Figure 9:
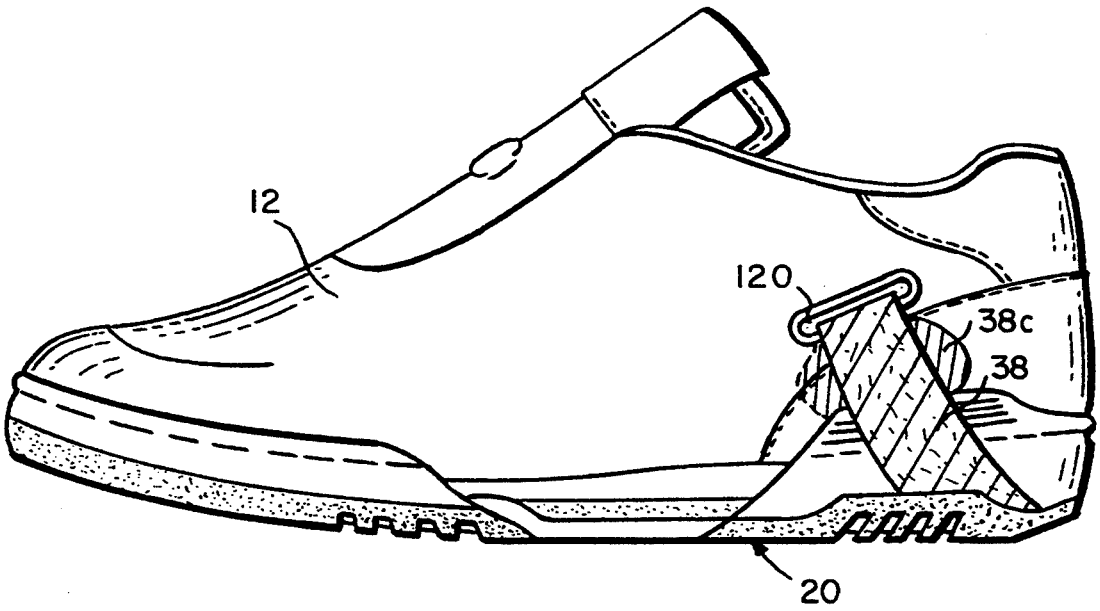
FIG. 9 is a side view of a shoe of the present invention illustrating another embodiment.

In another embodiment shown in FIG. 9, the extension 38 extends upwardly along the outside of the upper 12, through an aperture 120 in the upper 12 and then downwardly forming a flap 38C along an inside surface of the upper 12. The flap 38C is preferably attachable to and detachable from the inside surface of the upper 12, for example, by means of Velcro.

In another alternative embodiment of the invention, the entire inside surface of the upper 12 may be lined with a conductive cloth material such as Thunderon available from Nippon Sammo Dyeing Co., Ltd., Kyoto, Japan. In such an embodiment, the extension 38 is disposed in contact with the conductive cloth lining on the inside surface of the upper 12 in such a manner as shown in and described with reference to FIGS. 7, 9.

The electrical conduit created between the wearer's foot and the ground imparts a greater ability in the wearer to perform physical or muscular tasks relative to the same wearer wearing a shoe which does not provide such an electrical conduit. The following experiments demonstrate a significant increase in muscular physical performance when wearing a shoe according to the invention. In each of the following described experiments, the subjects' performances of physical exercises were carried out first on a non-conductive surface and then while standing, wearing only socks, on a sheet of conductive rubber according to the invention. The conductive conduit created between the wearer's foot and the ground by standing on a sheet of outsole conductive rubber is the same as is created when the wearer is wearing any shoe embodiment according to the invention. This was confirmed by measuring the conductivity between the foot and ground of a person standing on a sheet of outsole conductive rubber according to the invention and of the same person standing in a shoe having a mock up design most similar to the FIG. 6 embodiment with a conventional dissipative tester such as a FOOTWEAR TESTER, model FT-2630 available from Plastic Systems, Inc., Marlboro, Mass., at a setting of $1\times10^6$ ohms.

In the following experiments a sheet of rubber containing 40 parts of XC-72 carbon black (available from Cabot Corporation of Atlanta, Ga.) per hundred parts of rubber and 40 parts of N.550 carbon black) (available from Cabot Corporation of Atlanta, Ga.) per hundred parts of rubber was used as the conductive rubber component. The conductive rubber sheet was measured for volume resistivity and found to have a volume resistivity of about 37.5 ohms-cm. The ohmic path between a person and the ground was measured with the person standing on a copper ground plane and holding a copper bar connected to a positive electrode at chest level. Standing on the ground plane in non-conductive rubber outsoled shoes, no conductivity could be recorded. Standing with socks only on the ground plane a resistance of 90,000 ohms was measured. Standing in socks on the test sheet of conductive rubber which in turn was lying on top of the ground plane, a resistance of 195,000 ohms was measured.

In the following experiments, the physical performance comparisons were made between people first standing in stocking feet on a non-conductive surface, and second with the same people standing with their socks on, on top of the sheet of conductive test rubber described above with the rubber sheet lying on the floor.

EXPERIMENT 1

Fourteen (14) male subjects of about average health, height and weight between the ages of 12 and 48 were tested for increase in their ability to leap vertically upwards from an initial standstill. The subjects stood against a wall with one arm stretched upward to a maximum defining a vertical starting point. With feet spaced about 12 inches apart, the subjects first jumped upwardly as high as possible in stocking feet while standing on conventional non-conductive material (such as insulated rubber) and then in stocking feet initially standing on a sheet of conductive rubber according to the invention. The subjects exhibited the following percentage increases in leap height when standing on the conductive rubber: (a) 12.4%, (b) 3.5%, (c) 4.5%, (d) 4.6%, (e) 10.0%, (f) 23%, (g) 13.5%, (h) 8.5%, (i) 9.5%, (j) 11.6%, (k) 1.1%, (l) 11.2%, (m) 3.5%, (n) 4.5%.

EXPERIMENT 2

Three (3) male subjects of about average health, height and weight between the ages of 22 and 48 were tested for increased ability to perform weightlifting "curls." Using a Marcy Fastrack EMI weightlifting apparatus, each subject with feet spaced about 12 inches apart first attempted to curl the maximum amount of weight possible wearing non-conductive athletic footwear. The results for the three subjects were (a) 180 lbs., (b) 180 lbs., and (c) 170 lbs. Standing on a conductive outsole sheet according to the invention, the three subjects next were able to lift a maximum of (a) 190 lbs., (b) 190 lbs, and (c) 180 lbs., an average of about a 6% increase.

EXPERIMENT 3

Seven (7) male subjects of about average health, height and weight between the ages of 22 and 48 were tested for increased ability to compress to the maximum extent possible a manual compression exercise apparatus, known commercially as Bullworker Super XS which is disclosed in U.S. Pat. No. 4,290,600 assigned to Compret N. V., Amsterdam, Netherlands, believed to be the manufacturer thereof. With feet spaced about 12 inches apart, each subject attempted to compress the Bullworker compression device first wearing non-conductive shoes and then standing in stocking feet on a sheet of conductive rubber according to the invention. The subjects exhibited the following percentage increases in the maximum amount (measured in pounds) which they were able to manually compress the device: (a) 7.5%, (b) 7.5%, (c) 15%, (d) 6.3%, (e) 2%, (f) 5%, (g) 3%. The average increase was, therefore, 6.6%.

EQUIVALENTS

Although the specific features of the invention are shown in some drawings and not in others, this is for convenience only, as each feature may be combined with any or all of the other features in accordance with the invention.

It should be understood, however, that the foregoing description of the invention is intended merely to be illustrative thereof, that the illustrative embodiments are presented by way of example only, that other modifications, embodiments, and equivalents may be apparent to those skilled in the art without departing from its spirit.

Having thus described the invention, what we desire to claim and secure by Letters Patent is:

1. A shoe for creating an electrical conduit between a wearer's foot and the ground, comprising:

a non-electrically conductive upper portion for surrounding at least a portion of the wearer's foot above the sole of the wearer's foot;

one or more non-electrically conductive shoe sole layer components;

an electrically conductive shoe sole component rigidly and non-removably affixed to the upper portion, forming a bottom shoe sole surface for making substantial contact with the ground, the one or more non-electrically conductive shoe sole components being disposed above the electrically conductive sole component and separating the bottom of the wearer's foot from contact with the electrically conductive sole component;

means for integrally attaching the electrically conductive sole component to the upper portion, wherein said means for integrally attaching is disposed in contact with the electrically conductive sole component and the upper portion;

the electrically conductive component including an extension from the periphery of the conductive component extending upwardly around the periphery of the non-conductive components to the upper portion of the shoe such that the foot of the wearer makes direct substantial conductive contact with the extension;

wherein the means for attaching the electrically conductive component and the upper is stitching.

2. The shoe of claim 1 wherein the extension is an integral extension of the conductive sole component.

3. The shoe of claim 2 wherein the conductive sole component and the extension are formed as a unitary body of homogeneous material.

4. The shoe of claim 1 wherein the extension extends upwardly over a heel and a collar portion of the upper of the shoe such that at least a heel area of the wearer's foot makes substantial conductive contact with the extension.

5. The shoe of claim 1 wherein the extension is integrally attached to the upper portion of the shoe.

6. The shoe of claim 2 wherein the extension is integrally attached to the upper portion of the shoe.

7. The shoe of claim 3 wherein the extension is integrally attached to the upper of the shoe.

8. The shoe of claim 1 wherein the extension extends along an inside surface of the upper portion of the shoe.

9. The shoe of claim 8 wherein the extension is integrally attached to the upper portion of the shoe.

10. The shoe of claim 1 wherein the conductive shoe sole component comprises a rubber material and conductive particles dispersed throughout the rubber material.

11. The shoe of claim 3 wherein the conductive shoe sole component comprises a rubber material and conductive particles dispersed throughout the rubber material,

12. The shoe of claim 1 wherein the conductive shoe sole component has a resistivity of between about 10 and about 100 ohms-cm.

13. The shoe of claim 10 wherein the conductive shoe sole component has a resistivity of between about 10 and about 100 ohms-cm.

14. The shoe of claim 11 wherein the conductive shoe sole component has a resistivity of between about 10 and about 100 ohms-cm.

15. The shoe of claim 1 wherein the upward extension extends upwardly over an outer surface of the upper of the shoe and further extends over an inner surface of the upper of the shoe.

16. The shoe of claim 2 wherein the upward extension extends upwardly over an outer surface of the upper of the shoe and further extends over an inner surface of the upper of the shoe.

17. The shoe of claim 5 wherein the upward extension extends upwardly over an outer surface of the upper of the shoe and further extends over an inner surface of the upper of the shoe.

* * * * *